US007845105B1

(12) United States Patent
Cahill

(10) Patent No.: US 7,845,105 B1
(45) Date of Patent: Dec. 7, 2010

(54) FIREARM GRIP PANEL WITH INTERCHANGEABLE SWITCH INSERT

(75) Inventor: Jeffrey M. Cahill, Claremont, CA (US)

(73) Assignee: Tango Down, Inc., Tucson, AZ (US)

( * ) Notice: Subject to any disclaimer, the term of this patent is extended or adjusted under 35 U.S.C. 154(b) by 735 days.

(21) Appl. No.: 11/515,206

(22) Filed: Sep. 1, 2006

Related U.S. Application Data

(60) Provisional application No. 60/713,691, filed on Sep. 2, 2005.

(51) Int. Cl.
*F41C 23/00* (2006.01)

(52) U.S. Cl. ..... 42/72; 42/117; 200/86 R

(58) Field of Classification Search ..... 42/71.01, 42/72, 71.02, 117; 200/86 R
See application file for complete search history.

(56) References Cited

U.S. PATENT DOCUMENTS 4,987,277 A * 1/1991 Duhon ..... 200/86 R
5,816,550 A * 10/1998 Watanabe et al. ..... 248/222.11
6,490,822 B1 12/2002 Swan
7,191,557 B2 3/2007 Gablowski et al.
7,199,315 B1 * 4/2007 Sharrah et al. ..... 200/61.43
2005/0241206 A1 11/2005 Teetzel et al.
2006/0191183 A1 8/2006 Griffin
2007/0271832 A1 11/2007 Griffin

FOREIGN PATENT DOCUMENTS

WO WO 2007/067569 A1 6/2007

OTHER PUBLICATIONS

A.R.M.S., Inc.; Atlantic Research Marketing Systems, Inc. —Products List; http://www.armsmounts.com/list.html; 17pp.
A.R.M.S., Inc.; Atlantic Research Marketing Systems, Inc.—New Products; http://www.armsmounts.com/new.html; 10pp.
SWIFT Pressure Switch Panel; http://www.bizplaces.com/magpul/detail.asp?PRODUCT_ID=4675; 1 pg.

* cited by examiner

*Primary Examiner*—Stephen M Johnson
*Assistant Examiner*—Daniel J Troy
(74) *Attorney, Agent, or Firm*—Christie, Parker & Hale, LLP.

(57) ABSTRACT

A grip panel with removable interchangeable sliding or other type locking inserts that trap and fasten switches for firearm accessories such as white lights, lasers, invisible lasers and communication devices to the host firearm.

23 Claims, 8 Drawing Sheets

3D
3C
3B
3A
14
14a
14d
14b
12
12a
12b
12c
12d
12e
10
10a
10b
10c
10d
10e
10f
10g
10h
10i
10j 10a
10b
10

12
12b 14
14b

FIREARM GRIP PANEL WITH INTERCHANGEABLE SWITCH INSERT

CROSS-REFERENCE TO RELATED APPLICATION(S)

This application claims the benefit of U.S. Provisional Application Ser. No. 60/713,691, filed on Sep. 2, 2005, which is incorporated herein by reference.

FIELD OF THE INVENTION

This invention relates to a grip panel, and more particularly, to a grip panel and/or a firearm with a grip panel that secures pressure switches.

BACKGROUND OF THE INVENTION

Modern firearms often utilize accessories such as tactical lights, laser illuminators, laser target designators, communication devices, infra-red lights, illuminated sights, and holographic sights. Most of these accessories are operated by switches, including pressure switches. Such switches are currently mounted to firearms using double sided tape, elastic bands or hook and loop fasteners. Accordingly, a need exists for a firearm grip panel having a secure method of mounting a pressure switch.

SUMMARY OF THE INVENTION

One embodiment of the invention is a grip panel including a pocket panel base and locking inserts, sized and shaped to secure a pressure switch to a firearm rail. The pocket panel base includes a pocket depression which accommodates a pressure switch. One locking tab on the base locks the base to the firearm rail. A second locking tab, located in the pocket depression may be used to lock the inserts after the switch is slid into place.

In another embodiment, a grip panel includes a pocket panel base and locking inserts, sized and shaped to secure a pressure switch to a firearm rail. The pocket panel base includes a pocket depression which accommodates a pressure switch. The base is secured to the firearm rail. A locking tab, located in the pocket depression may be used to lock the inserts after the switch is slid into place.

In yet another embodiment, a grip panel includes a pocket panel base and locking inserts, sized and shaped to secure a pressure switch to a firearm rail. The pocket panel base includes a pocket depression which accommodates a pressure switch. The base is secured to the firearm rail. Locking inserts, located in the pocket depression may be used to secure the switch after it is slid into place.

DETAILED DESCRIPTION OF EXEMPLARY EMBODIMENTS

One embodiment of the invention provides a grip panel with removable interchangeable sliding or other type locking inserts that trap and fasten switches for firearm accessories such as laser sight lines, lights, laser illuminators, laser target designators, infra-red lights, illuminated sights, holographic sights, and communication devices to the host firearm.

Figure 1:
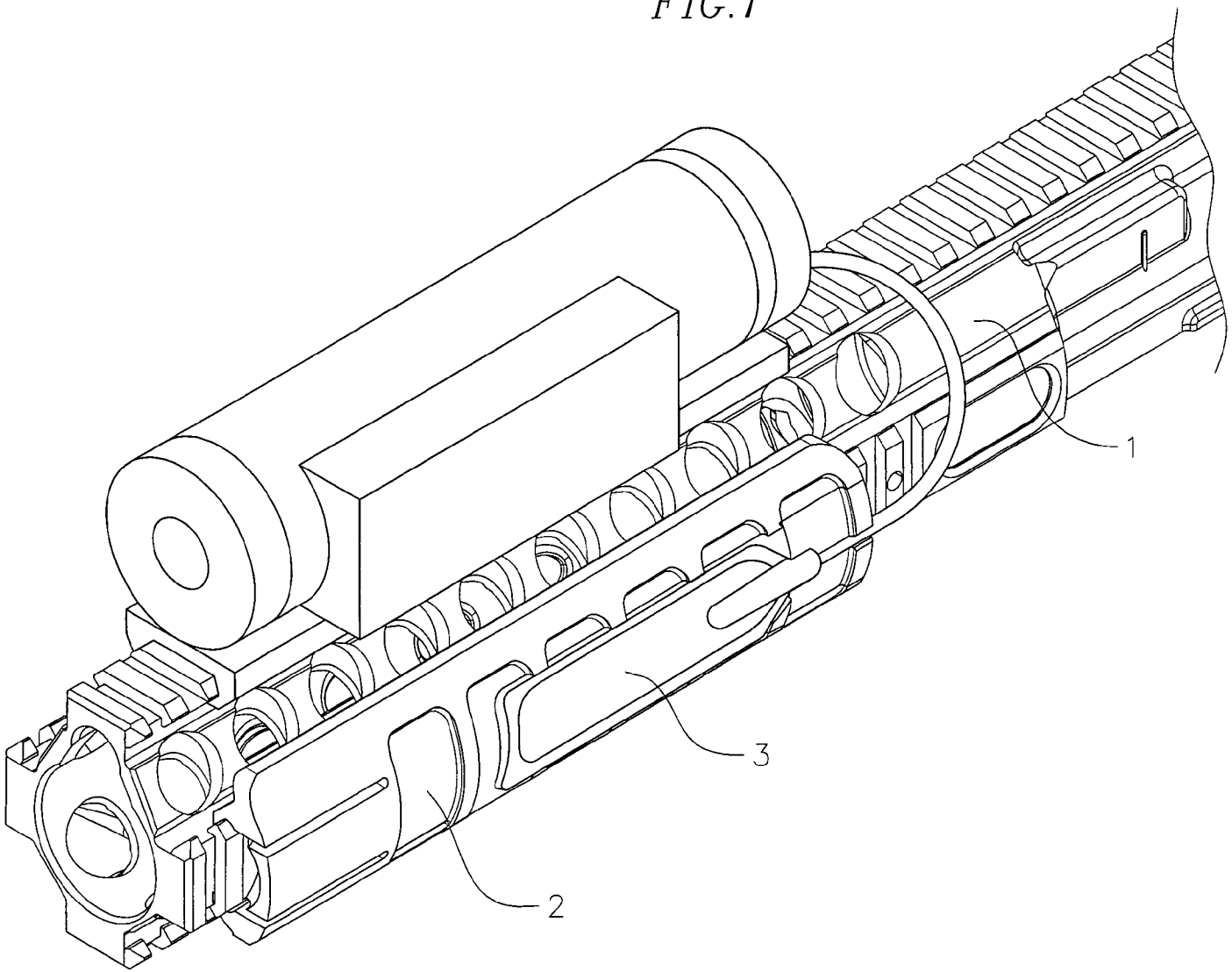
FIG. 1 is an overhead view of a firearm with a grip panel and pressure switch according to one embodiment of the invention.
Figures 4, 5, 6:
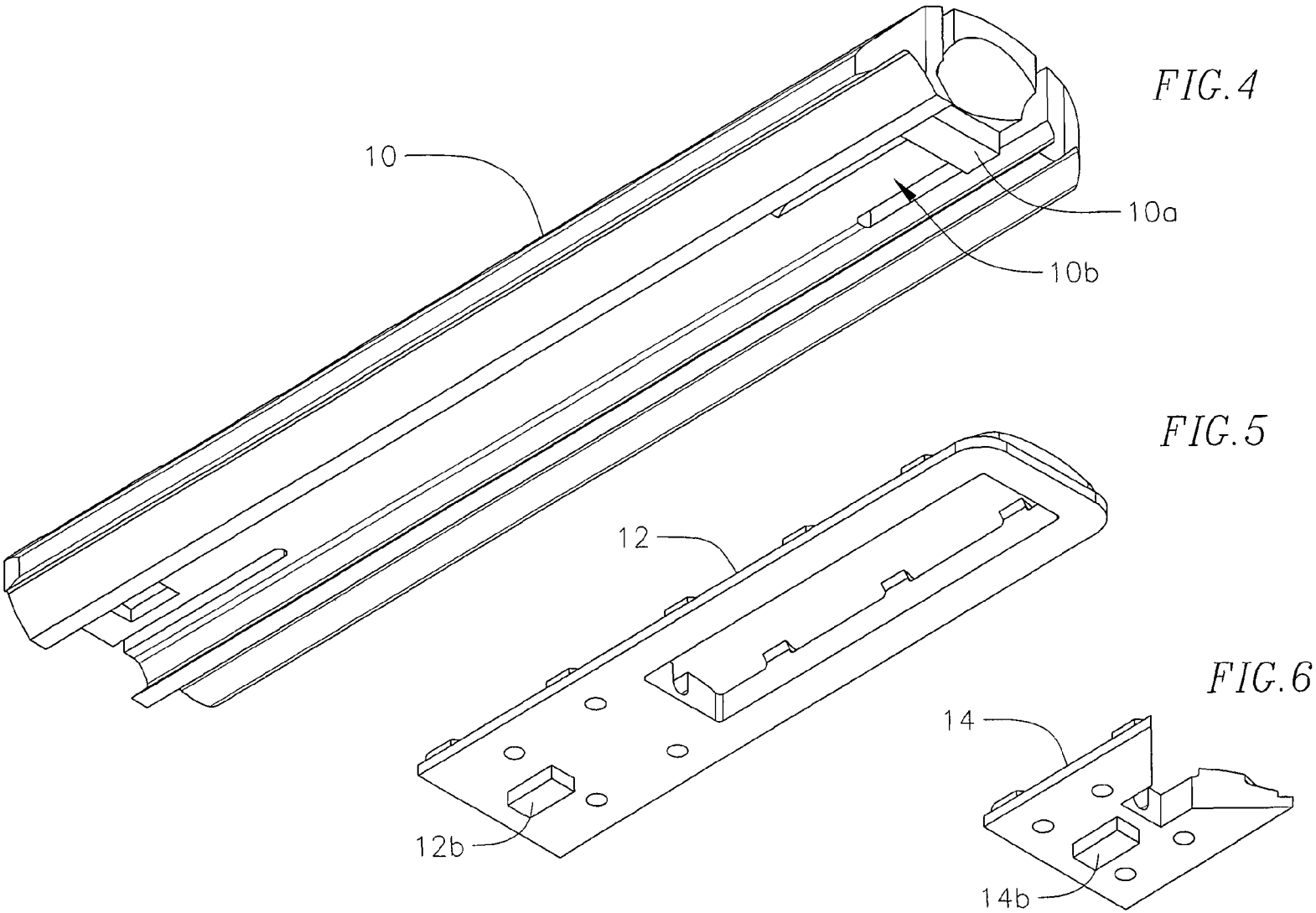
FIG. 4 is a perspective view of the bottom of the grip panel according to one embodiment of the invention.
FIG. 5 is a perspective view of the bottom of an insert according to one embodiment of the invention.
FIG. 6 is a perspective view of the bottom of an insert according to one embodiment of the invention.
Figure 7:
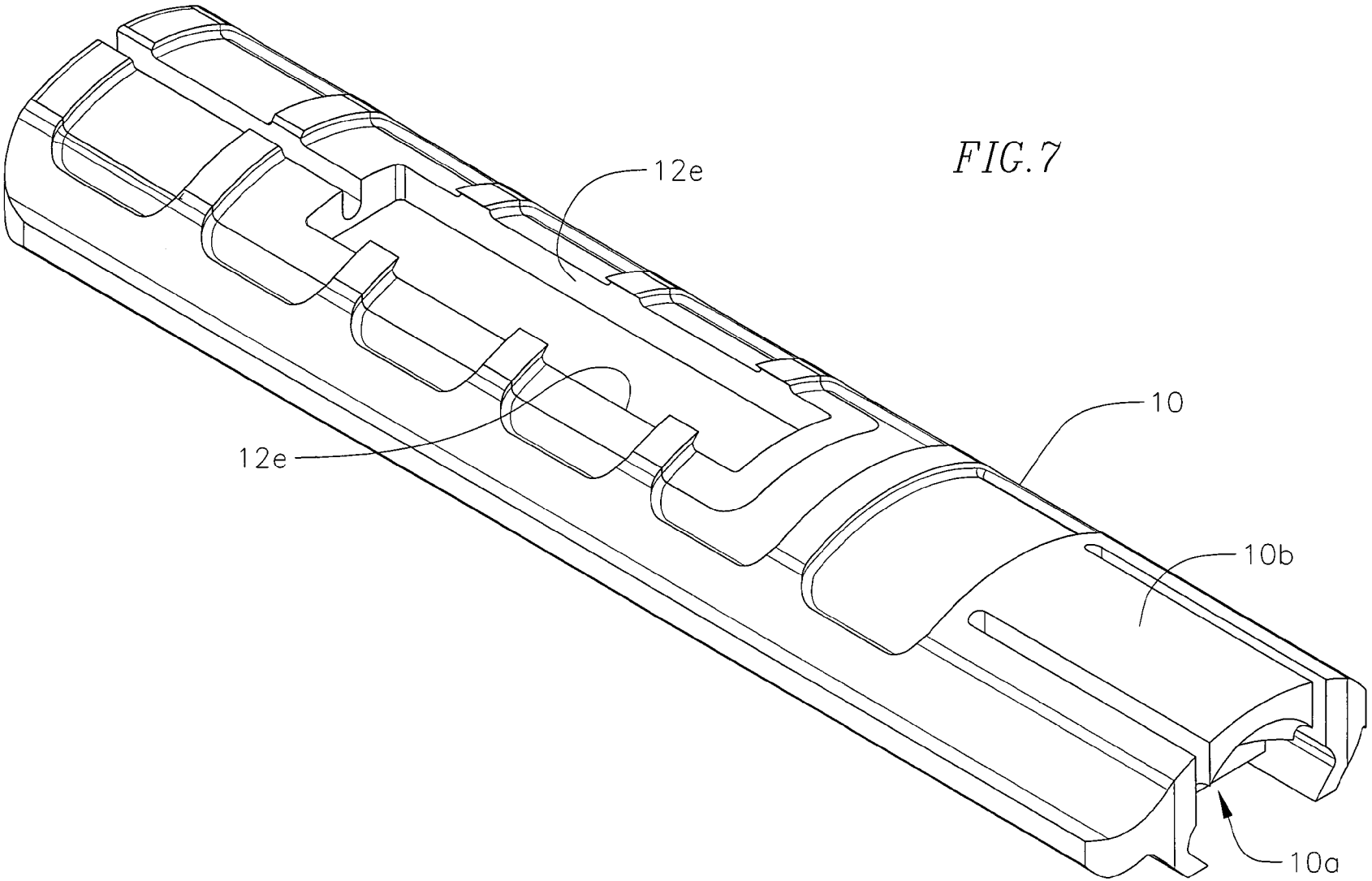
FIG. 7 is a perspective view of the grip panel according to one embodiment of the invention.

As shown in FIG. 1, an embodiment of the invention allows a secure and protected switch installation 3 on a firearm 1 with a MIL-STANDARD 1913 Picatinny rail using a grip panel 2. As shown in FIGS. 4, 7, the base panel 10 is locked into the firearm rail by a tab 10*a* on an elongated flexible member 10*b* that, once the base panel 10 is slid onto the rail, is trapped and cannot disengage. When properly engaged, the top of the flexible member 10*b* latch is flush with the remainder of the top of the base panel 10 as shown in FIG. 7.

In another embodiment, the base panel 10 may be secured to the firearm rail by using any fastening means, such as metal fasteners, locking metal clips. Modifications to the firearm rail may need to be made to accommodate the metal fasteners or clips.

Figure 2:
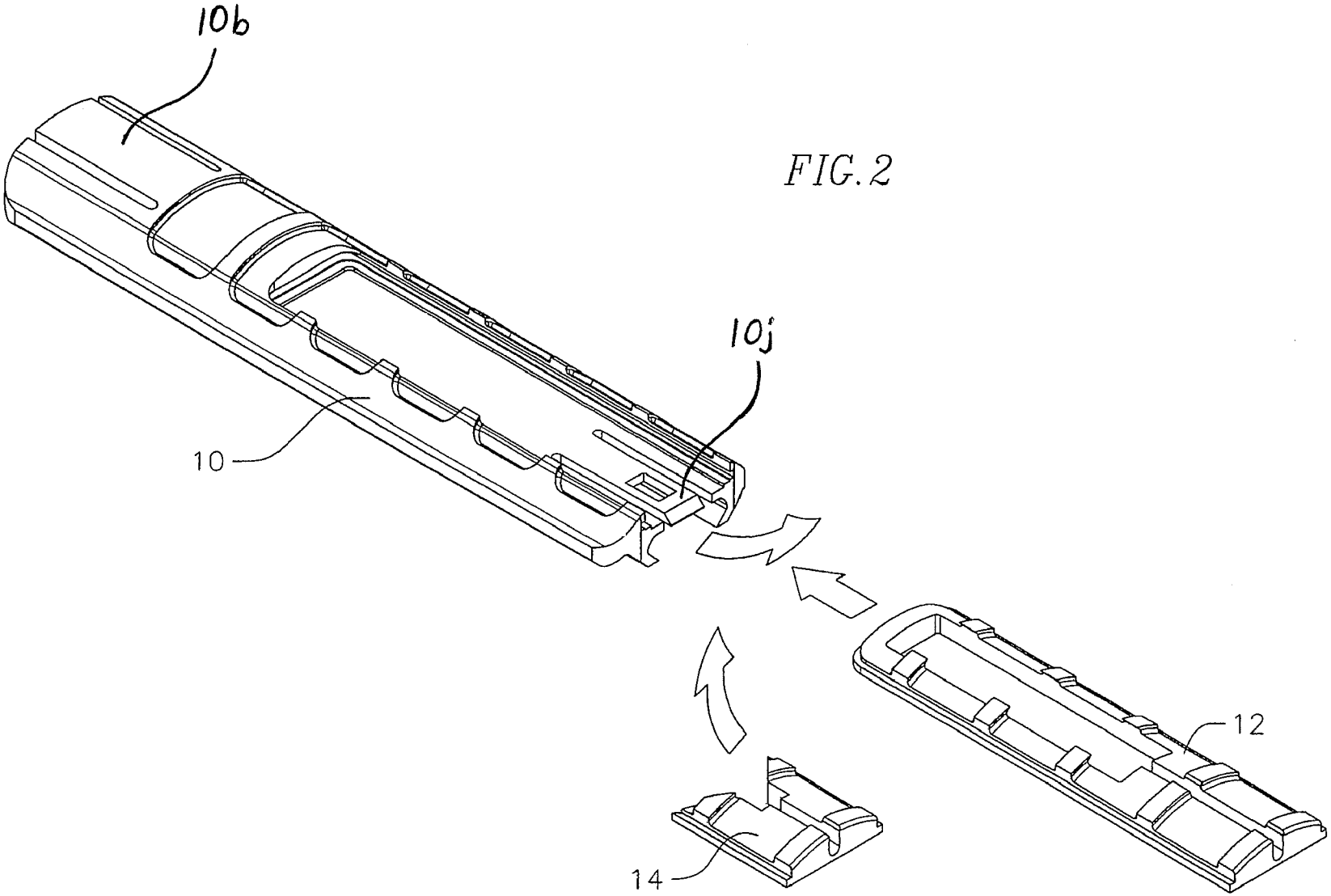
FIG. 2 is a schematic illustration of the grip panel and inserts according to one embodiment of the invention.

In one embodiment, as shown in FIG. 2, pressure switch insert adapters 12, 14 are available for many different models of switch and slide into base panel 10. Embodiments of the pocket panel base will now be described in more detail.

Figures 3, 3A, 3B, 3C, 3D:
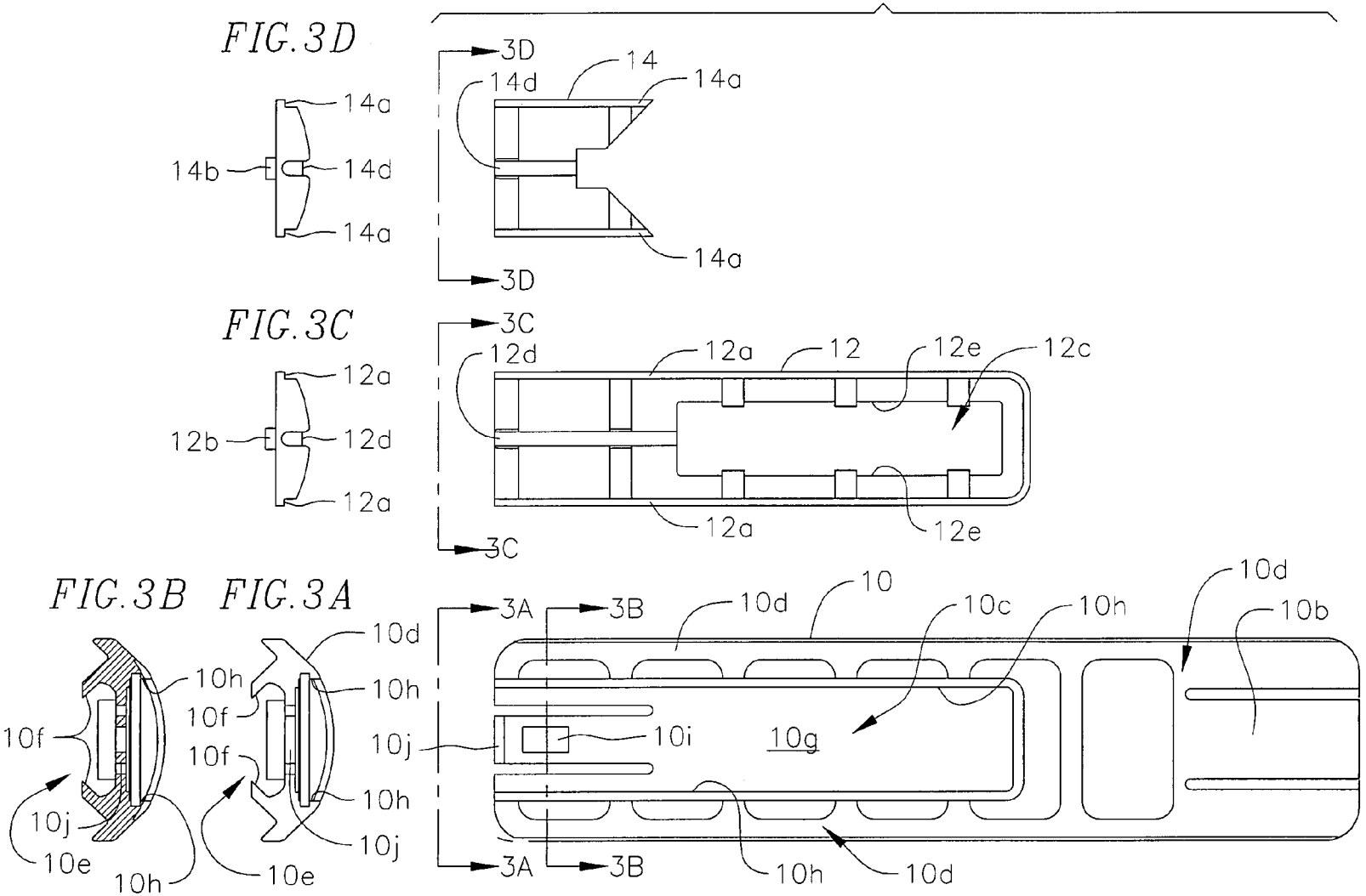
FIG. 3 is an overhead view of the grip panel and inserts according to one embodiment of the invention.
FIGS. 3A-3D are cross sectional views of the grip panel and inserts in FIG. 3.

As shown in FIG. 3, one embodiment of a pocket panel base 10 of the present invention slides on to the rail and has a rectangular pocket 10*c* depression on the top side to receive the inserts 12, 14. In an embodiment, a base panel 10 has a profile where the top 10*d* is rounded and the bottom 10*e* is flat except for two projections with a dovetail profile 10*f* on the inside edge, which engage the profile of a firearm rail.

In one embodiment, the portion of the base panel 10 engaging a pressure switch is a rectangular depression 10*g* centered in the area of the base panel 10 extending from one short edge towards the interior of the panel. In an embodiment, this U shaped depression 10*g* has a smooth surface on the bottom and dovetail overhangs 10*h* on the sides to engage similar projections on the sides 12*a*, 14*a* of inserts 12, 14. At the edge of the depression 10*g* is a rectangular hole 10*i* that will engage, in one embodiment, rectangular in cross section locking projection 12*b*, 14*b* on the bottom surface of the insert 12, 14. In one embodiment, the thickness of the material at resilient tab 10*j* between the smooth surface of the panel and the side that touches the rail is thin and resilient to allow the bottom of the depression 10*g* to act as a flexible tab.

In another embodiment, instead of, or in addition to using the resilient tab 10*j* to secure the inserts 12, 14 to the base panel 10 after the switch has been inserted, other mechanical securing means are used, such as adhesive compounds like glue, adhesive tape, metal clips, darts and other mechanical anchoring methods. In an embodiment, it is not necessary for the inserts to have a locking projection 12*b*, 14*b* on the bottom surface.

Embodiments of the inserts 12, 14 will now be described in more detail. Each insert 12, 14 is sized and shaped so that the operational (top) portion of the switch is exposed to the user's fingers while the remainder of the switch is sandwiched between the base rail panel 10 and the insert 12, 14 on the outside.

Figure 8:
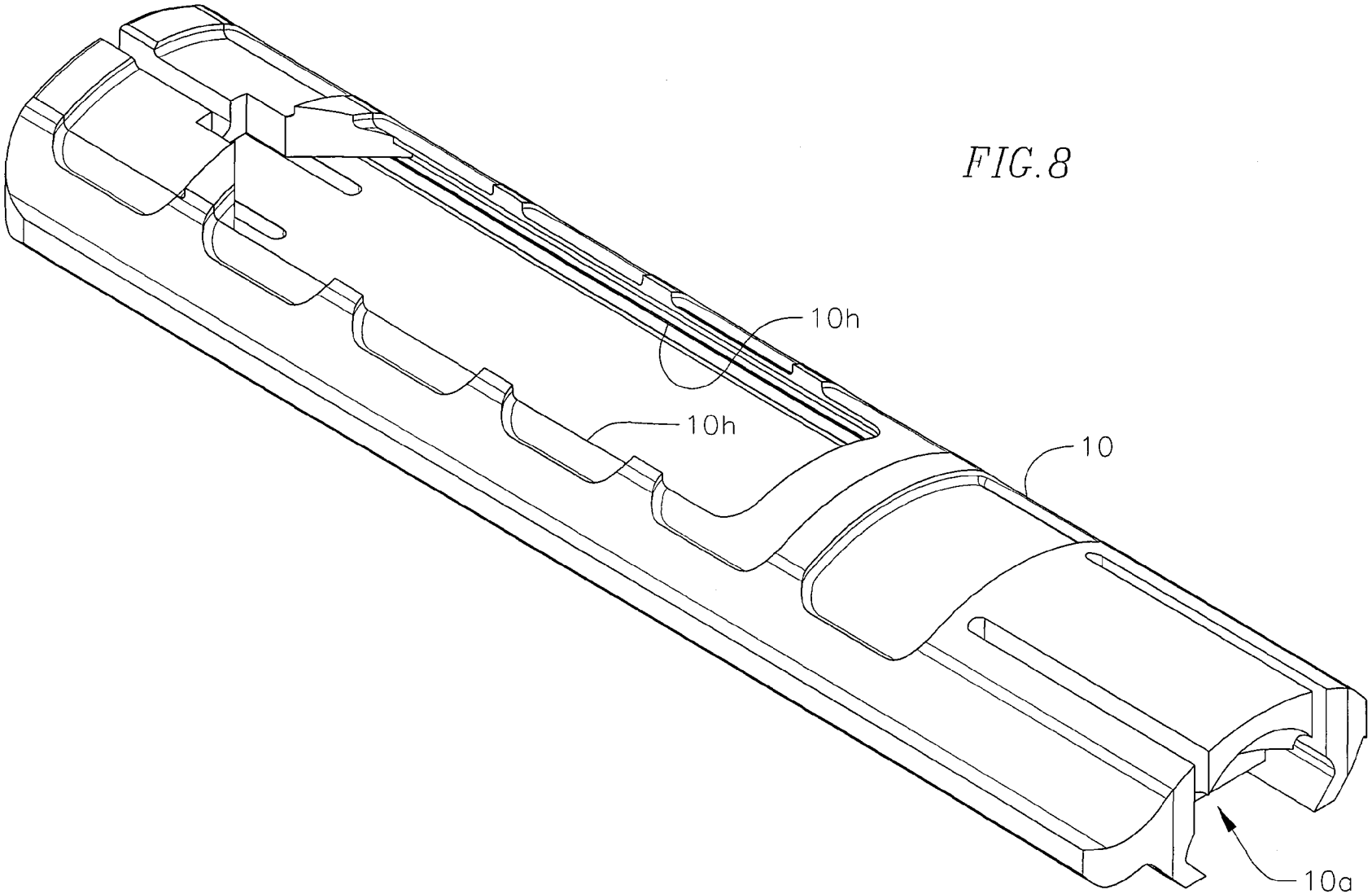
FIG. 8 is a perspective view of the grip panel according to one embodiment of the invention.

In one embodiment, the O-type, the insert 12 is rectangular in outer shape, as seen in FIG. 3, with a rectangular hole 12*c* in it where the dimension is slightly under the overall dimension of a pressure switch. FIG. 5 shows the underside of insert 12 according to an embodiment. A groove 12*d* runs through the bottom or top of the insert 12 to accept the wire from the switch. The outer edges of the switch engage the downward diverging sides 12*e* of the pocket depression formed by the hole 12*c* as shown in FIG. 8.

In another embodiment, the wedge type, the insert 14 is rectangular in outer shape that acts as a wedge for switches which are too large to fit in the hole of the O-type 12. FIG. 6 shows the underside of FIG. 4 according to one embodiment. As shown in FIG. 3, a groove 14*d* runs through the bottom or top of the insert 14 to accept the wire from the switch. The outer edges of the switch engage the underside of downward diverging sides 10*h* of the pocket depression 10*g* as shown in FIG. 8.

Figure 9:
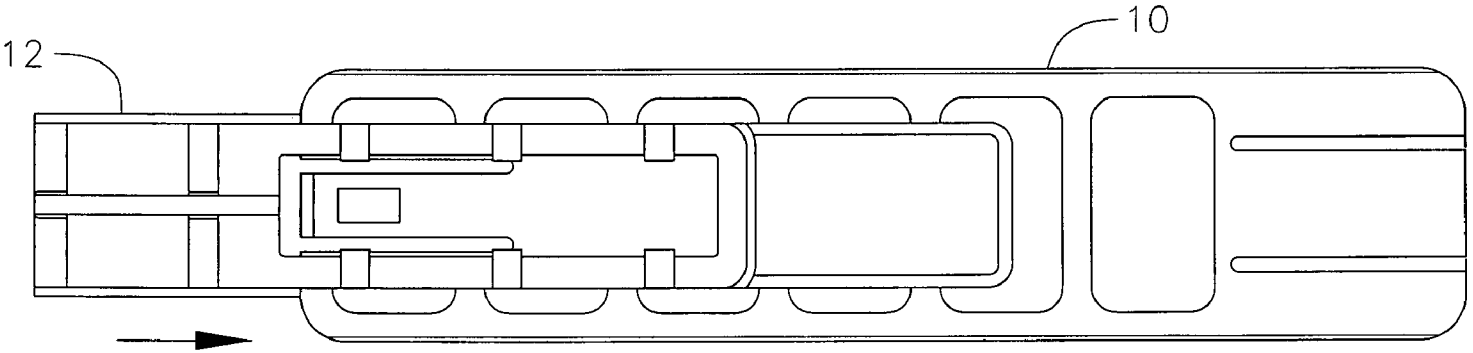
FIG. 9 is an overhead view of a partially assembled grip panel according to one embodiment of the invention.
Figure 10:
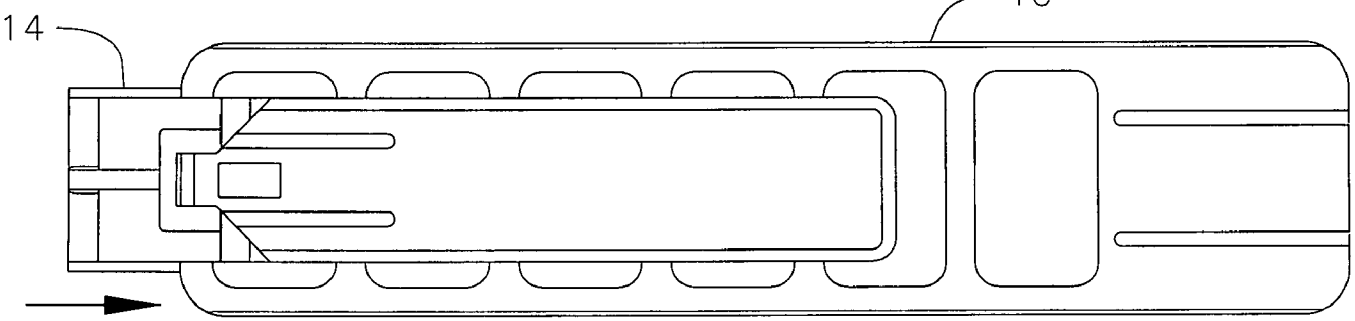
FIG. 10 is an overhead view of a partially assembled grip panel according to one embodiment of the invention.
Figure 11:
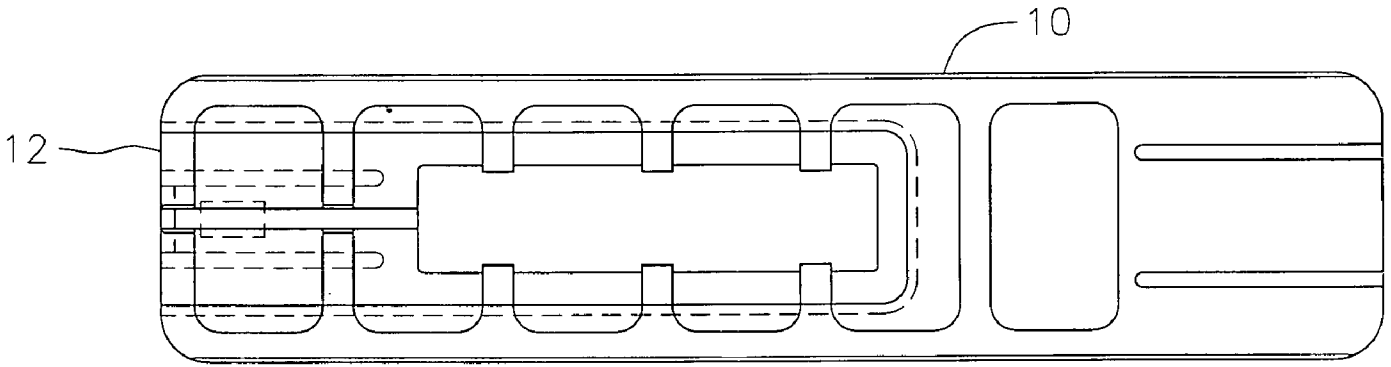
FIG. 11 is an overhead view of an assembled grip panel according to one embodiment of the invention.
Figure 12:
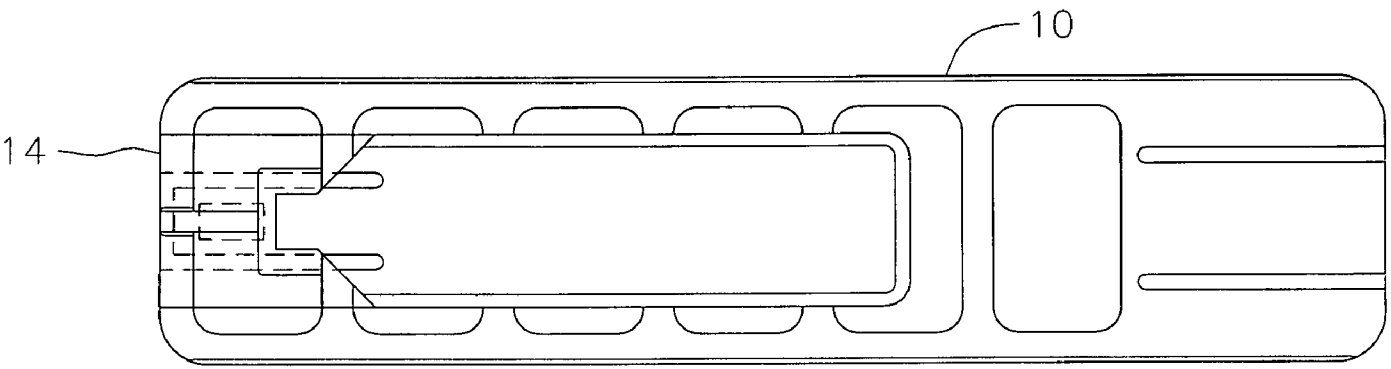
FIG. 12 is an overhead view of an assembled grip panel according to one embodiment of the invention.

FIGS. 9, 10 illustrate how inserts 12,14 may be slid into the base panel 10. Once an insert 12,14 is slid into the base panel and locked in, it cannot move out of engagement nor can the switch it traps as shown in FIGS. 11, 12 respectively.

Any number of inserts that slide into the pocket depression to trap a switch underneath can be manufactured to accommodate different sizes of switches. In one embodiment, two popular switches useful in the present invention are the Sure-Fire® switch and the switches from Insight Technologies®.

Grip panels of one embodiment of the present invention have superior heat and impact resistance.

The preceding description has been presented with reference to various embodiments of the invention. Persons skilled in the art and technology to which this invention pertains will appreciate that alterations and changes in the described structures and methods of operation can be practiced without meaningfully departing from the principle, spirit and scope of this invention.

What is claimed is:

1. A grip panel for attachment to a firearm, the grip panel comprising:

a locking insert; a pressure switch; and a pocket panel base having first and second opposite ends, comprising:

a top portion comprising a first flexible locking tab at the first end of the pocket panel base for securing the pocket panel base to a firearm accessory rail;

a pocket depression between the first and second ends of the pocket panel base, adapted to receive the pressure switch and the locking insert, and a second flexible locking tab at the second end of the pocket panel base adapted to secure the locking insert to the pocket panel base, and a bottom portion adapted to slide onto a firearm accessory rail, wherein the locking insert is adapted to mount in the pocket depression and to engage the second flexible locking tab, and wherein the first and second flexible locking tabs are deflectable in a direction that runs toward and away from the top portion and the bottom portion.

2. The grip panel of claim 1, wherein the locking insert comprises a locking projection and the second flexible locking tab comprises a hole that engages the locking projection.

3. The grip panel of claim 1, wherein the pocket depression comprises an overhang, and wherein the locking insert comprises a flange that is slidable into the pocket depression below the overhang.

4. The grip panel of claim 1, wherein the locking insert is rectangular in outer shape and comprises an opening with a diverging side for retaining the pressure switch.

5. The grip panel of claim 1, wherein the locking insert is wedge shaped.

6. The grip panel of claim 1, wherein the locking insert comprises a groove for accepting a wire from the pressure switch.

7. The grip panel of claim 1, wherein the first locking tab comprises a projection extending downwardly from the pocket panel base to lock the pocket panel base to the firearm accessory rail.

8. A grip panel for attachment to a firearm, the grip panel comprising:

a locking insert; a pressure switch; and a pocket panel base having first and second opposite ends, and having a longitudinal direction extending between the first and second ends, the pocket panel base comprising:

a top portion comprising a pocket depression extending in the longitudinal direction of the pocket panel base, and having a side opening at a first end of the depression, and wherein the side opening is adapted to receive the pressure switch and the locking insert, and a flexible locking tab adapted to secure the locking insert to the pocket panel base, and a bottom portion comprising a profile that is slidable onto a firearm accessory rail, wherein the locking insert is slidable in the longitudinal direction into the pocket depression through the side opening in the pocket depression and thereby fits into the first end of the pocket depression and closes the side opening, and wherein the locking insert is dimensioned to trap the pressure switch between the locking insert and the pocket panel base.

9. The grip panel of claim 8, wherein the locking insert comprises a locking projection and the second flexible locking tab comprises a hole that engages the locking projection.

10. The grip panel of claim 8, wherein the pocket depression comprises an overhang, and wherein the locking insert comprises a flange that is slidable into the pocket depression below the overhang.

11. The grip panel of claim 8, wherein the locking insert comprises an opening with a diverging side for retaining the pressure switch.

12. The grip panel of claim 8, wherein the locking insert is wedge shaped.

13. The grip panel of claim 8, wherein the locking insert comprises a groove for accepting a wire from the pressure switch.

14. A grip panel for attachment to a firearm, the grip panel comprising:

a locking insert having a central opening;

a pocket panel base comprising:

a top portion comprising a pocket depression having a planar bottom surface, the pocket depression being adapted to receive a pressure switch and the locking insert, and a bottom portion comprising a profile that is slidable onto a firearm accessory rail in gripping engagement with such rail, and a pressure switch retained by the locking insert, wherein the locking insert is adapted to mount in the pocket depression and secure a pressure switch and is slidable into the pocket depression in a direction parallel to the planar bottom surface of the pocket depression, and wherein the locking insert traps the pressure switch between the locking insert and the pocket panel base with a portion of the pressure switch being exposed through the central opening of the locking insert, for operation of the pressure switch.

15. The grip panel of claim 14, wherein the locking insert is secured to the pocket panel base using a mechanical anchor.

16. The grip panel of claim 14, wherein the locking insert is secured to the pocket panel base using an adhesive compound.

17. The grip panel of claim 14, wherein the central opening of the locking insert comprises a diverging side for retaining the pressure switch.

18. The grip panel of claim 14, wherein the locking insert comprises a groove for accepting a wire from the pressure switch.

19. The grip panel of claim 14, wherein the pressure switch and the locking insert contact the planar bottom surface of the pocket depression.

20. The grip of claim 14, wherein the locking insert is slidable into the pocket depression with a bottom surface of the locking insert sliding in contact with the planar bottom surface of the pocket depression.

21. The grip of claim 14, wherein the pocket depression further comprises an overhang extending over the planar bottom surface of the pocket depression, and wherein a portion of the locking insert is slidable into the pocket depression under the overhang.

22. A grip panel for attachment to a firearm, the grip panel comprising:

a locking insert; a pressure switch; and a pocket panel base comprising:

a top portion comprising a pocket depression having a planar bottom surface, the pocket depression being adapted to receive the pressure switch and the locking insert, and a bottom portion adapted to slide onto a firearm accessory rail, wherein the locking insert is adapted to mount in the pocket depression and secure the pressure switch and is slidable into the pocket depression in a direction parallel to the planar bottom surface of the pocket depression, wherein the pocket panel base further comprises a flexible, downwardly extending tab for locking the pocket panel base to the firearm accessory rail, and wherein the bottom portion of the pocket panel base further comprises a dovetail profile for engaging the firearm rail.

23. An accessory system for a firearm comprising:

a grip panel slidable onto a firearm rail; and a pressure switch retained by the grip panel, wherein the grip panel comprises:

an elongated base panel comprising a pocket depression with an overhang on opposite sides of the depression and comprising a dovetail profile on a bottom portion of the base panel that grips such firearm rail; and a locking insert that is received under the overhang and that comprises downwardly diverging sides on opposite sides of the insert, creating a central opening in a top portion of the grip panel, wherein the locking insert traps the pressure switch between the downwardly diverging sides of the locking insert and the depression of the base panel, with a portion of the pressure switch being exposed between the downwardly diverging sides and through the central opening for operation of the pressure switch, and wherein the base panel further comprises a flexible member at an end of the base panel, the flexible member including a downward projection that engages such firearm rail and is adapted to lock the base panel in place in position along such firearm rail.

* * * * *